US008991440B2

(12) United States Patent
Ueda et al.

(10) Patent No.: US 8,991,440 B2
(45) Date of Patent: Mar. 31, 2015

(54) INDUSTRIAL TWO-LAYER FABRIC

(71) Applicant: Nippon Filcon Co., Ltd., Tokyo (JP)

(72) Inventors: Ikuo Ueda, Shizuoka (JP); Toru Egawa, Shizuoka (JP); Yoshihisa Kondou, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 82 days.

(21) Appl. No.: 13/836,292

(22) Filed: Mar. 15, 2013

(65) Prior Publication Data

US 2013/0284305 A1 Oct. 31, 2013

(30) Foreign Application Priority Data

Apr. 26, 2012 (JP) ..... 2012-100662

(51) Int. Cl.

| | |
|---|---|
| ***D03D 11/00*** | (2006.01) |
| ***D03D 3/04*** | (2006.01) |
| ***D21F 1/00*** | (2006.01) |
| *D03D 23/00* | (2006.01) |

(52) U.S. Cl.

CPC ..... *D03D 11/00* (2013.01); *D21F 1/0045* (2013.01)

USPC ..... 139/383 A; 139/383 R; 139/413; 139/408; 162/358.2

(58) Field of Classification Search

USPC ..... 139/383 A, 383 R, 410, 425 A; 162/358.2, 358.1, 902; 442/203, 206, 442/208

See application file for complete search history.

(56) References Cited

U.S. PATENT DOCUMENTS

| | | | | |
|---|---|---|---|---|
| 5,482,567 | A | 1/1996 | Barreto | |
| 5,490,543 | A * | 2/1996 | Fujisawa | 139/383 A |
| 5,632,310 | A * | 5/1997 | Yasuoka | 139/383 A |
| 5,829,489 | A * | 11/1998 | Kuji | 139/383 A |
| 6,155,308 | A * | 12/2000 | Kuji | 139/410 |
| 7,464,731 | B2 * | 12/2008 | Fujisawa | 139/383 A |
| 7,819,141 | B1 * | 10/2010 | Ueda | 139/383 A |
| 7,882,857 | B1 * | 2/2011 | Ueda | 139/383 A |
| 7,896,035 | B2 * | 3/2011 | Ueda et al. | 139/383 A |
| 2007/0095417 | A1 * | 5/2007 | Fujisawa | 139/383 A |
| 2010/0132825 | A1 * | 6/2010 | Fujisawa | 139/413 |
| 2010/0252137 | A1 * | 10/2010 | Ueda | 139/413 |

FOREIGN PATENT DOCUMENTS

| | | | |
|---|---|---|---|
| DE | 3318990 | A1 | 11/1984 |
| EP | 0672782 | A1 | 9/1995 |

(Continued)

OTHER PUBLICATIONS

Extended Search Report issued in EP Application No. 13163425.5, dated Oct. 25, 2013.

(Continued)

*Primary Examiner* — Bobby Muromoto, Jr.

(74) *Attorney, Agent, or Firm* — Rader, Fishman & Grauer PLLC

(57) ABSTRACT

An industrial two-layer fabric has an inner space between an upper side fabric and a lower side fabric. Some or all of upper side wefts or lower side wefts are secondary wefts interwoven with upper side warps or lower side warps so as to make the number of warps passing on an upper surface of the upper side fabric or passing on a lower surface of the lower side fabric larger than that on an inner space side of the upper or lower side fabric and a long crimp in the inner space is formed by the secondary weft.

7 Claims, 12 Drawing Sheets

(56) References Cited

FOREIGN PATENT DOCUMENTS

| | | | |
|---|---|---|---|
| EP | 0794283 | A1 | 9/1997 |
| EP | 1502977 | A2 | 2/2005 |
| EP | 1630271 | A2 | 3/2006 |
| JP | 2004-068168 | A | 3/2004 |

OTHER PUBLICATIONS

Partial European Search Report issued in EP Application No. 13163425.5, dated Jul. 23, 2013.

* cited by examiner

FIG.2
FIG.2A
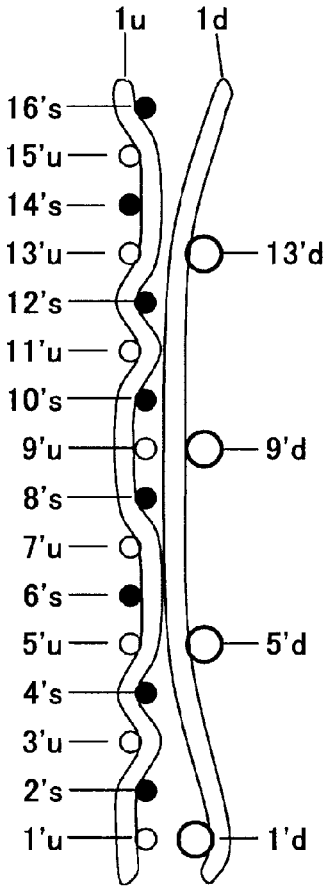
FIG.2B
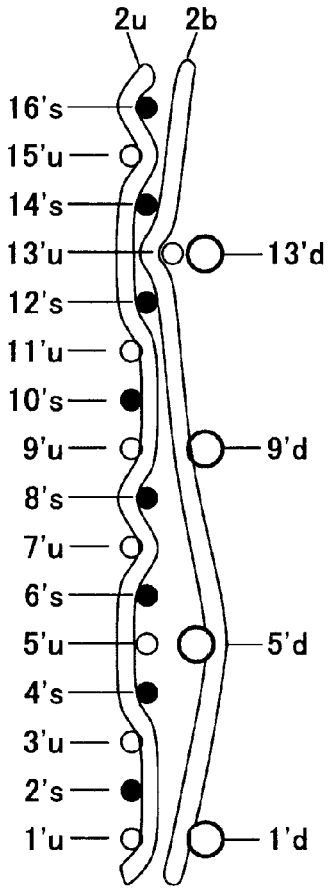
FIG.2C
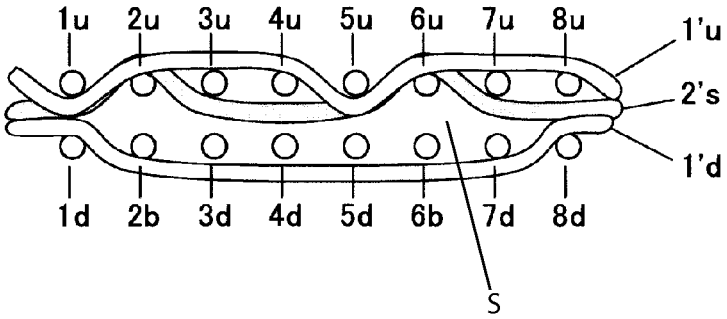

FIG.3
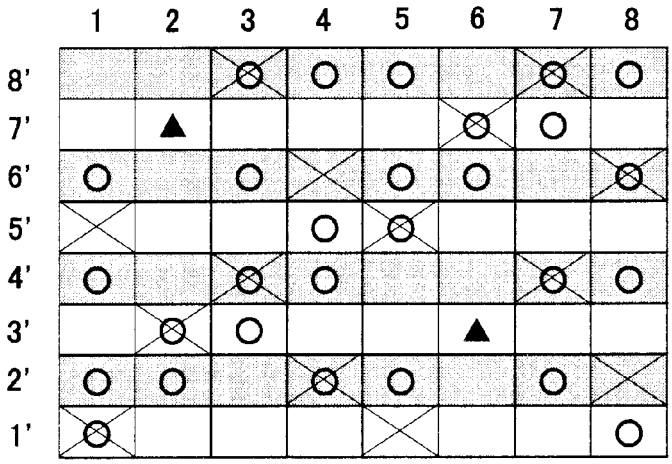
FIG.4
FIG.4A
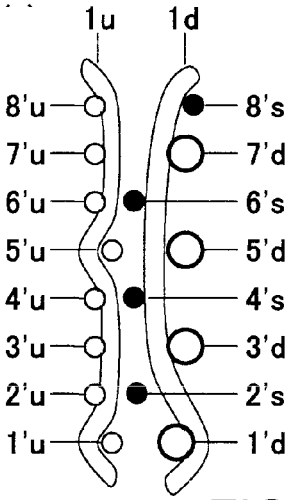
FIG.4B
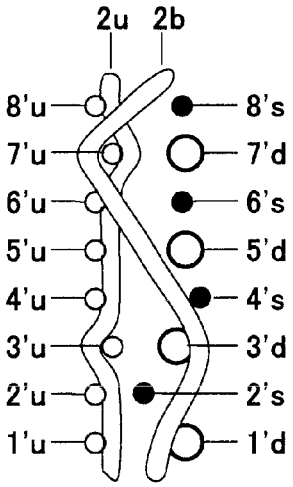
FIG.4C
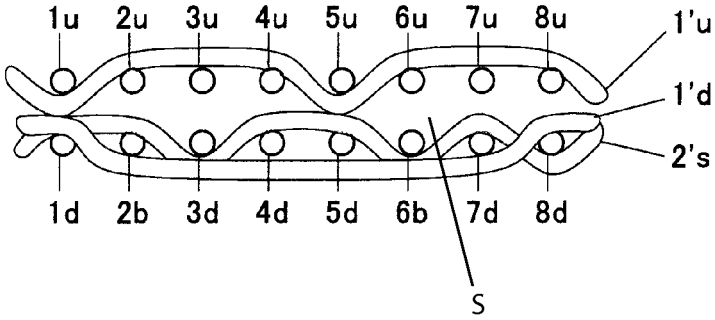

FIG.6
FIG.6A
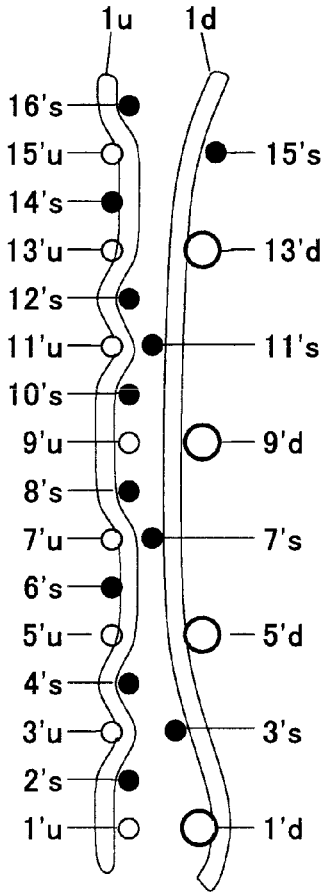
FIG.6B
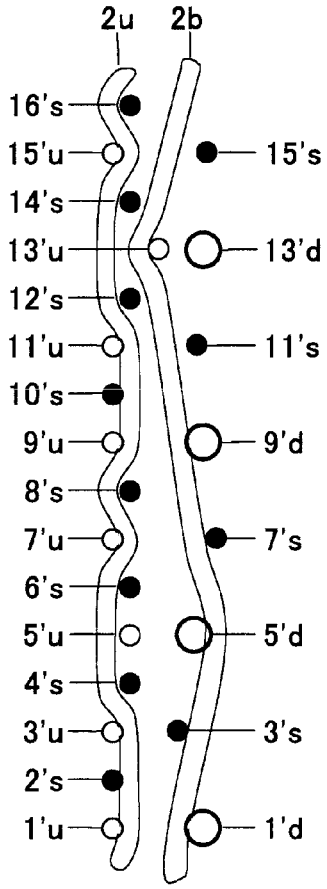
FIG.6C
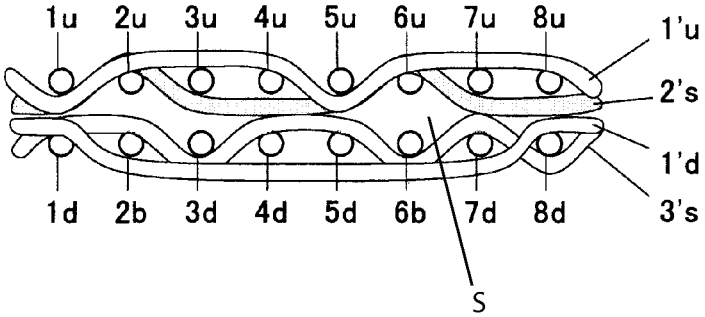

FIG.8
FIG.8A
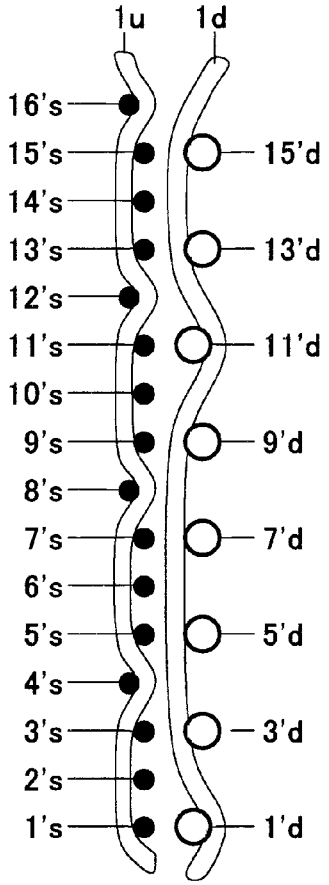
FIG.8B
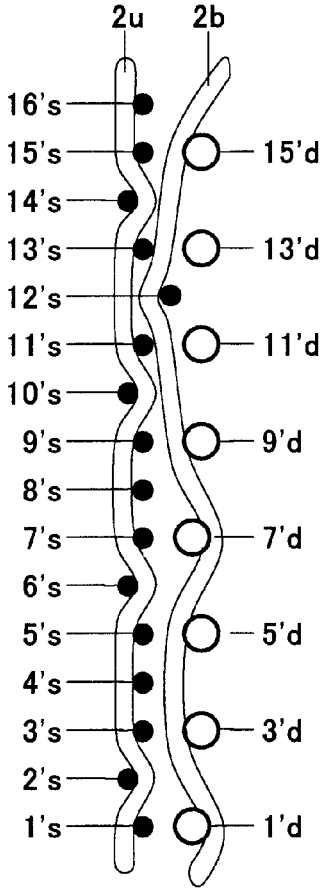
FIG.8C
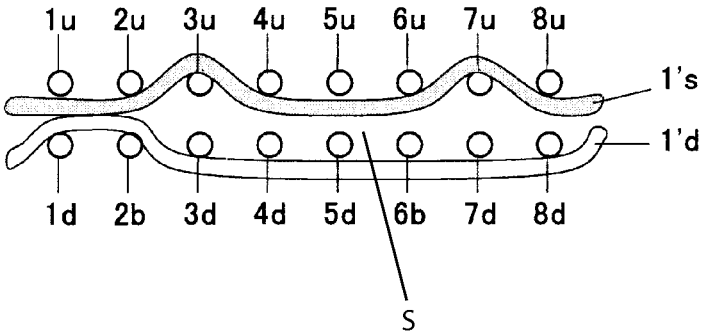

FIG.10
FIG.10A
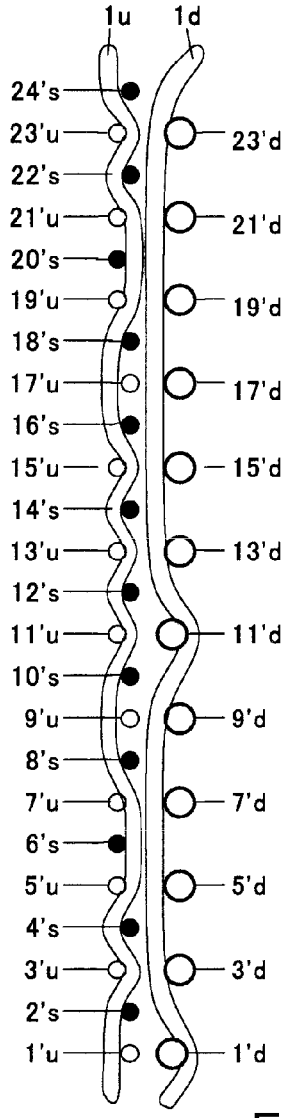
FIG.10B
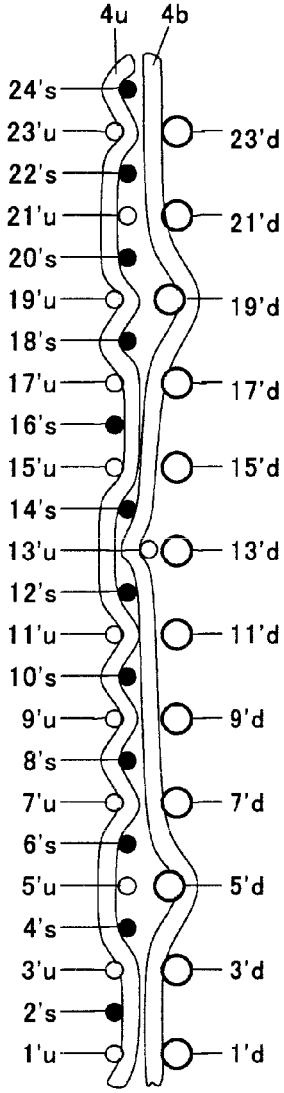
FIG.10C
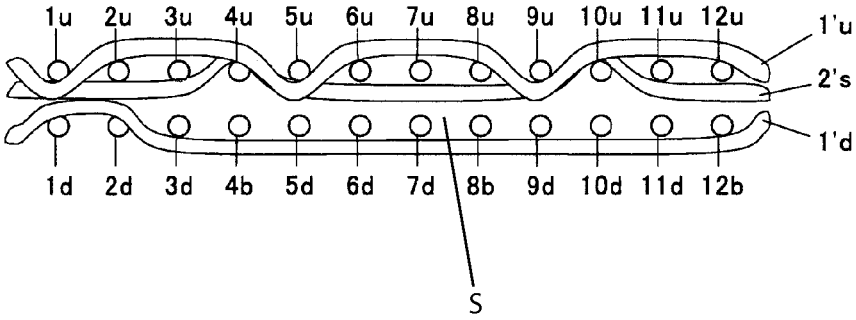

FIG.12
FIG.12A
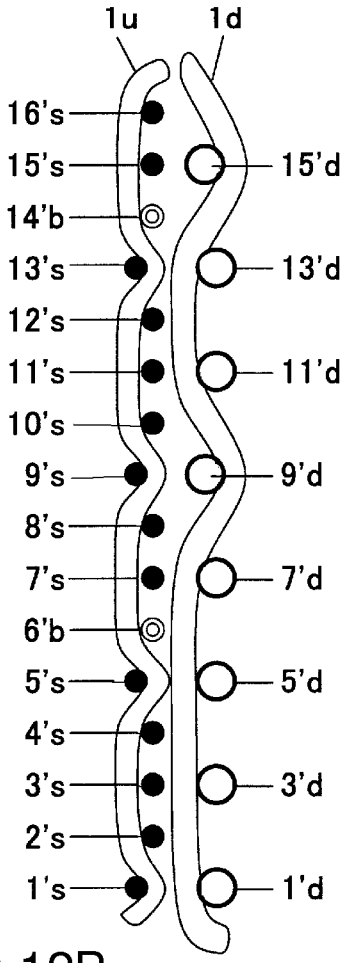
FIG.12B
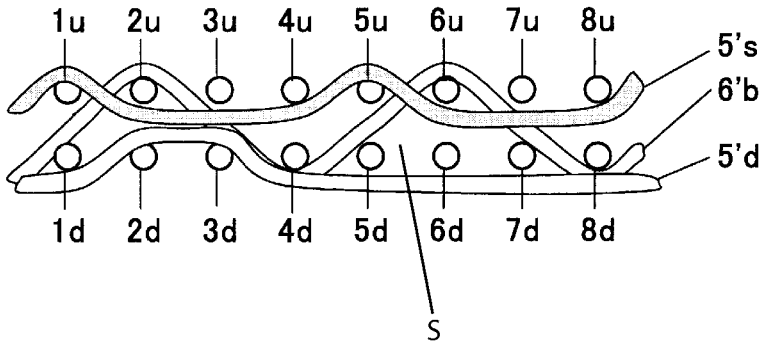

FIG.13
Related Art
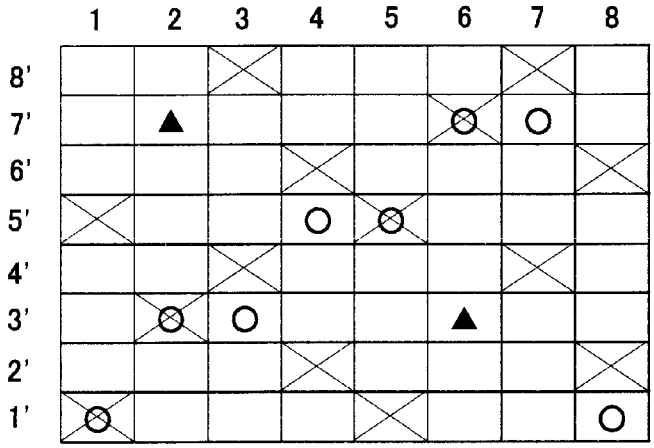
FIG.14
Related Art
FIG.14A
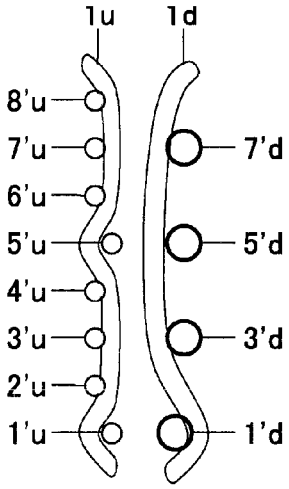
FIG.14B
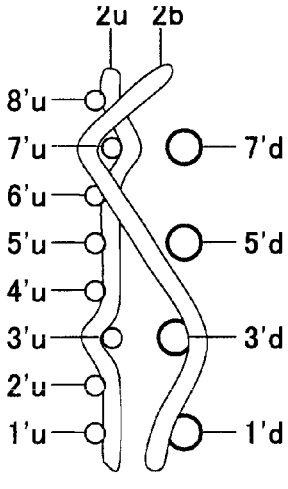
FIG.14C
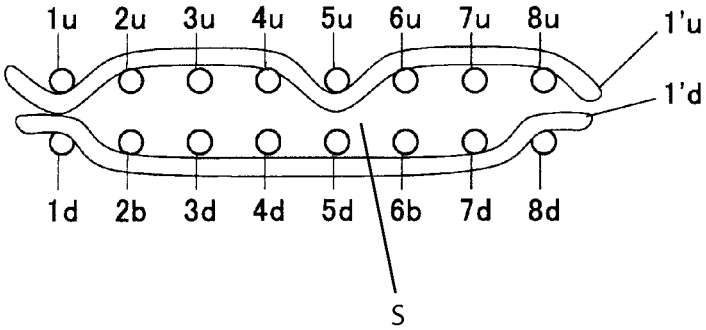

INDUSTRIAL TWO-LAYER FABRIC

BACKGROUND OF THE INVENTION

1. Field of the Invention

The present invention relates to an industrial fabric having uniform drainage characteristics throughout the fabric, which is obtained by reducing a water retention amount in the inner space of the fabric during papermaking without changing the thickness of a wire or fabric, thereby retaining required characteristics of the fabric such as drainage property, surface properties, and rigidity and at the same time, suppressing transfer of marks onto a paper made using the fabric, generation of splash, or the like.

2. Description of the Related Art

Fabrics obtained by weaving warps and wefts have conventionally been used widely as an industrial fabric. They are, for example, used in various fields including papermaking fabrics, conveyor belts, and filter cloths and are required to have fabric characteristics suited for the intended use or using environment. Of such fabrics, a papermaking fabric used in a papermaking step for removing water from raw materials by making use of the mesh openings of the fabric should satisfy a severe demand.

For example, there is a demand for the development of papermaking fabrics that have excellent surface smoothness so as not to cause transfer of a wire mark of the fabric to paper, have a drainage property and filterability (air permeability) to sufficiently and uniformly dehydrate excessive water contained in the raw materials, have enough rigidity and wear resistance that enable suited use even under severe environments, and can maintain conditions necessary for making good paper for a prolonged period of time.

In addition, industrial fabrics are required to have a fiber supporting property, improved papermaking yield, dimensional stability, running stability, and the like. In recent years, owing to the speed-up of a paper making machine, requirements for papermaking fabrics have become severer.

Most of the required characteristics of industrial fabrics and solutions thereof can be understood from a description on papermaking fabrics on which the most severe demand is imposed among industrial fabrics. Therefore, a description will next be made with papermaking fabrics as an example.

With a recent increase in the speed of a papermaking machine, papermaking fabrics are required to have a particularly excellent drainage property and surface smoothness. Although drainage characteristics which they are required to have are different with the type of a papermaking machine or the type of a product to be manufactured, a uniform drainage property is one of necessary conditions which any product should have.

Further, it becomes more difficult to satisfy the required characteristics of papermaking fabrics because an increase in the mixing rate of minute fibers in raw materials as a result of recent increased use of waste paper causes insufficient drainage so that sufficient and uniform drainage has gained importance (see, for example, Japanese Patent Application Publication No. 2004-68168).

In order to satisfy such required characteristics, the fabric having an improved drainage property has conventionally been obtained mainly by providing a drainage trench on the lower surface side of a papermaking fabric. For example, improvement of the drainage property has been achieved by decreasing the diameter of wefts to increase their density, thereby reducing loss of fibers and overlapping upper side warps with lower side warps in a perpendicular direction.

Upon papermaking, however, water to be removed is inevitably retained in the inner space of the papermaking fabric and interferes with drainage. In addition to this problem, splash at the folded-back end portion of the papermaking fabric in a papermaking machine contaminates the periphery of the machine.

For example, FIGS. 13 and 14 are design diagrams showing one example of a currently used industrial fabric of a related art. The term "design diagram" as used herein means a minimum repeating unit (which may be called as a "complete design") of a fabric pattern and this complete design is horizontally and perpendicularly connected to each other to form the entire fabric pattern.

FIG. 14A is a schematic view of the related art showing the longitudinal section taken along an upper side warp (1*u*) and a lower side warp (1*d*) of FIG. 13. FIG. 14B is a schematic view showing the longitudinal section taken along an upper side warp (2*u*) and a warp binding yarn (2*b*) of FIG. 13. FIG. 14C is a schematic view showing a cross section taken along an upper side weft (1'*u*) and a lower side weft (1'*d*) of FIG. 13.

In the design diagram, warps are indicated by Arabic numerals, for example, 1, 2, 3 . . . and 8. The warps are composed of an upper side warp and a lower side warp or in some places, an upper side warp and a warp binding yarn. As shown in FIGS. 14A-14C, upper side warps are indicated by numerals with u, lower side warps are indicated by numerals with d, and warp binding yarns are indicated by numerals with b. For example, as shown in FIG. 14A, the warp 1 is composed of an upper side warp (1*u*) and a lower side warp (1*d*).

Wefts are indicated by Arabic numerals with prime, for example, 1', 2', 3' . . . 8'. Depending on the arrangement ratio of wefts, there are sites where an upper side weft and a lower side weft are placed perpendicularly and sites where only an upper side weft is placed. As shown in FIG. 14, upper side wefts are indicated by numerals with u and lower side wefts are indicated by numerals with d. For example, weft 1' is composed of an upper side weft 1'*u* and a lower side weft 1'*d*.

In the design diagrams of FIGS. 1, 3, 5, 7, 9, 11 and 13, the symbol "x" shows that an upper side warp (u) is located on an upper side weft (u) and forms a knuckle on the upper side surface of the upper side fabric; the symbol "▲" shows that a warp binding yarn (b) interweaves with an upper side weft (u) and forms a knuckle on the upper side fabric; the symbol "○" shows that a lower side warp (d) is located below a lower side weft (d) and forms a knuckle on the lower side surface of the lower side fabric.

In the industrial fabric shown in FIG. 13, upper side wefts (u) and lower side wefts (d) overlap in a perpendicular direction at (upper side weft (u)):(lower side weft (d)) arrangement ratio of 2:1. This means that the upper side wefts (u) from 1' to 8' are arranged, while lower side wefts (d) of 1', 3', 5', and 7' are arranged. According to the design diagram, yarns are arranged perpendicularly while being overlapped exactly for convenience of the diagram, but they may be misaligned in actual fabrics.

As shown in FIG. 14A, an upper side warp (1*u*) goes over one upper side weft (1'*u*), goes under three upper side wefts (2'*u* to 4'*u*), goes over one upper side weft (5'*u*), and goes under three upper side wefts (6 to 8'*u*) and thus they are interwoven. On the lower surface side, on the other hand, a lower side warp (1*d*) goes under one lower side weft (1'*d*) and goes over three lower side wefts (3'*d*, 5'*d*, 7'*d*) and thus they are interwoven.

In such a constitution, as shown in FIG. 14C, a portion lacking in, between the upper side weft (1'*u*) and the lower side weft (1'*d*), the upper side wefts (2*u*, 3*u*, 4*u*, 6*u*, 7*u*, 8*u*), the lower side warps (3*d*, 4*d*, 5*d*, 7*d*), and the warp binding yarns (2*b*, 6*b*) becomes an inner space (S). Upon papermaking, water to be removed is retained in such an inner space (S).

Improvement in a drainage property has conventionally been achieved mainly by providing a drainage trench on the lower surface side of a papermaking fabric. Even if a trench is provided on the lower surface side, it is impossible to overcome the problem because when water to be removed is retained in the inner space of the industrial two-layer, it disturbs drainage and moreover, causes splash.

In order to reduce the inner space, a simple increase in the amount of yarns in the inner space can be considered, but an increase in the number of yarns in the inner space may cause a new problem, that is, an increase in the thickness of a wire or fabric compared with that of the conventional fabric.

SUMMARY OF THE INVENTION

An object of the invention is to provide an industrial two-layer fabric having a function of retaining required characteristics of the fabric such as drainage property and rigidity and suppressing transfer of marks to paper made using the fabric, generation of splash, or the like by reducing a water retention amount in the inner space of the fabric during papermaking without impairing surface smoothness and increasing the thickness of a wire or a fabric.

With a view to decreasing the water retention amount in the inner space of a fabric during papermaking, the inventors have decided to form a long crimp or a long knuckle capable of keeping the surface smoothness of the fabric and having a knuckle in the inner space. Described specifically, the inventors have employed the following constitutions in order to overcome the above-mentioned problem.

This invention relates to an industrial two-layer fabric that contains an upper side fabric and a lower side fabric that are interwoven and combined with a warp binding yarn or a weft binding yarn. The upper side warps and the upper side wefts are woven together and form the upper side fabric, whereas the lower side warps are woven with the lower side warps and form the lower side fabric. The upper side fabric and the lower side fabric are interwoven with a warp binding yarn or a weft binding yarn and thereby form an inner space between the upper side fabric and the lower side fabric. The upper side wefts include a secondary upper side weft. A number of the upper side warps passing on the secondary upper side weft is larger than a number of the upper side warps passing under the secondary upper side weft so that the secondary upper side weft forms a long crimp in the inner space. Alternatively, the lower side wefts include a secondary lower side weft. A number of the lower side warps passing under the secondary lower side weft is larger than a number of the lower side warps passing over the secondary lower side weft so that the secondary lower side weft forms a long crimp in the inner space.

The upper side wefts may include both a primary upper side weft and the secondary upper side weft. A number of the upper side warps that pass under the primary upper side weft is larger than a number of the upper side warps that pass over the primary upper side weft so that the primary upper side weft forms a long crimp on an upper surface of the upper side fabric. In this case, the lower side wefts may be a primary lower side weft only and exclude the secondary lower side weft. A number of the lower side warps that pass over the primary lower side weft is larger than a number of the lower side warps that pass under the primary upper side weft so that the primary lower side weft forms a long crimp on a lower surface of the lower side fabric.

The lower side wefts of the industrial two-layer fabric may include both the primary lower side weft and the secondary lower side weft. In this case, the secondary upper side weft may be excluded from the upper side wefts. Further, the upper side wefts may include the primary upper side weft only. The primary lower side weft and the secondary lower side weft may be placed alternately.

The upper side wefts of the industrial two-layer fabric may include the secondary upper side weft only. In this case, the secondary lower side weft may be eliminated from the lower side wefts. Alternatively, the upper side wefts may include the primary upper side weft only.

The industrial two-layer fabric according to the invention has, as constituent yarns, upper side warps and upper side wefts constituting an upper side fabric and lower side warps and lower side wefts constituting a lower side fabric. For the upper side fabric and the lower side fabric, either a warp binding yarn or a weft binding yarn is used. In the invention, since some or all of the wefts are made up of the secondary upper or lower wefts, using the warp binding yarn is preferred.

BRIEF DESCRIPTION OF THE DRAWINGS

FIGS. 2A and 2B are schematic views showing the longitudinal sections taken along an upper side warp and a lower side warp and FIG. 2C is a schematic view showing the cross-section taken along an upper side weft and a lower side weft;

FIG. 3 is a design diagram showing the complete design of Embodiment 2 according to the invention;

FIGS. 4A and 4B are schematic views showing the longitudinal sections taken along an upper side warp and a lower side warp and FIG. 4C is a schematic view showing the cross-section taken along an upper side weft and a lower side weft.

FIGS. 6A and 6B are schematic views showing the longitudinal sections taken along an upper side warp and a lower side warp and FIG. 6C is a schematic view showing the cross-section taken along an upper side weft and a lower side weft;

FIGS. 8A and 8B are schematic views showing the longitudinal sections taken along an upper side warp and a lower side warp and FIG. 8C is a schematic view showing the cross-section taken along an upper side weft and a lower side weft;

FIGS. 10A and 10B are schematic views showing the longitudinal sections taken along an upper side warp and a lower side warp and FIG. 10C is a schematic view showing the cross-section taken along an upper side weft and a lower side weft;

FIG. 12A is a schematic view showing the longitudinal section taken along an upper side warp and a lower side warp and FIG. 12B is a schematic view showing the cross-section taken along an upper side weft and a lower side weft;

FIG. 13 is a design diagram showing the complete design according to a related art; and FIGS. 14A and 14B are schematic views showing the longitudinal sections taken along an upper side warp and a lower side warp and FIG. 14C is a schematic view showing the cross-section taken along an upper side weft and a lower side weft in FIG. 13.

DESCRIPTION OF THE INVENTION

Figure 1:
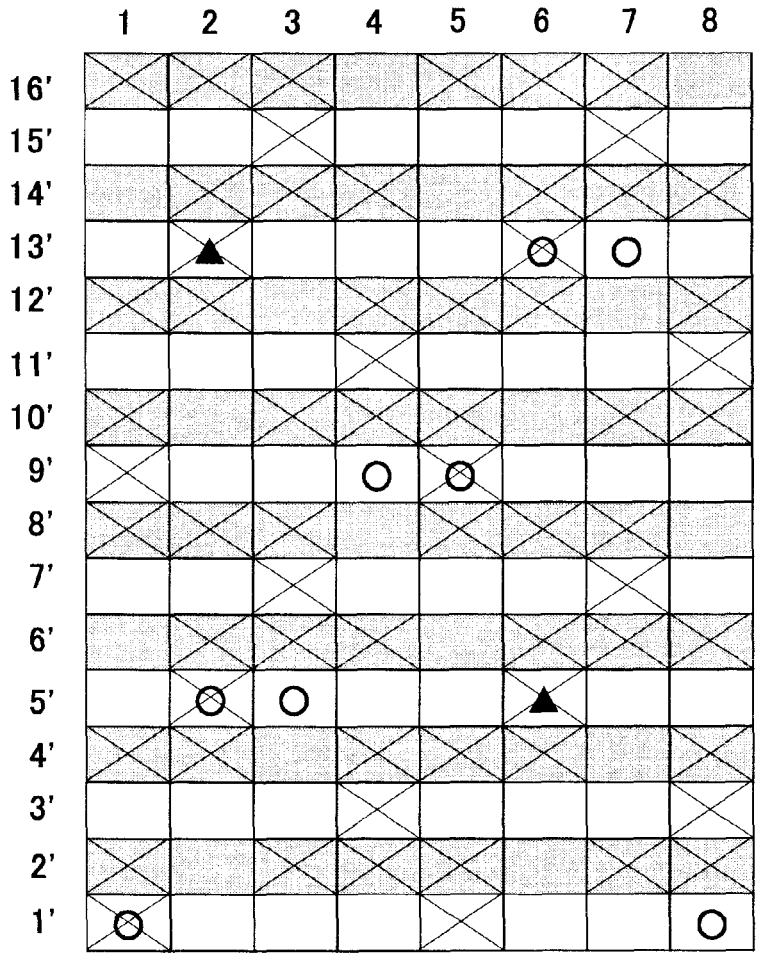
FIG. 1 is a design diagram showing the complete design of Embodiment 1 according to the invention.

The term "inner space" as used herein means a space formed between the upper side fabric and the lower side fabric. Water to be removed tend to be retained in this space during papermaking.

The term a "primary weft" as used herein means a weft interwoven with warps so as to make a number of warps passing in an inner space side is greater than a number of warps passing on the upper surface side of the upper side fabric or the lower surface side of the lower side fabric. In the case of a "primary upper side weft," the number of warps that passes under the primary upper side weft on the inner space side of the upper side fabric is greater than the number of warps that pass over the primary upper side weft on the upper surface side. In the case of a "primary lower side weft," on the other hand, the number of warps that pass over the primary lower side weft on the inner space side of the lower side fabric is greater than the number of warps that pass under the secondary lower side weft on the lower surface side of the lower side fabric. The primary weft includes both the primary upper side weft and the primary lower side weft.

The term of a "secondary weft" as used herein means a weft interwoven so as to make the number of warps passing on the upper surface side of the upper side fabric or lower surface side of the lower side fabric is greater than the number of warps passing in the inner space side of the upper side fabric or lower side fabric. In the case of a "secondary upper side weft," the number of warps that passes over the secondary upper side weft on the upper surface side of the upper side fabric is greater than the number of warps that pass under the secondary upper side weft on the inner space side of the upper side fabric. In the case of a "secondary lower side weft," on the other hand, the number of warps that pass under the secondary lower side weft on the lower surface side of the lower side fabric is greater than the number of warps that pass over the secondary lower side weft on the inner space side of the lower side fabric. The secondary weft includes the secondary upper side weft and the secondary lower side weft.

By weaving the fabric in the above-mentioned manner, a long crimp having a knuckle in the inner space is formed with a secondary weft. The long crimp in the present application has at least one site where two or more warps have been interwoven successively per secondary weft in a complete design. It is particularly preferred that the long crimp in the invention has a site where two or more warps passing on the upper surface side or the lower surface side of the fabric are placed successively per secondary weft in a complete design.

When a warp interweaves with such a secondary weft as a constituent yarn of an industrial two-layer fabric, a long knuckle (crimp) formed by two or more wefts or a knuckle formed by a single weft appears in the inner space of the fabric. By forming a long knuckle or a knuckle with wefts in the inner space, the volume of the inner space can be decreased greatly compared with the conventional industrial two-layer fabric, making it possible to reduce a water retention amount upon papermaking.

In the conventional design, a centrifugal force works strongly at a folded-back portion of a fabric at which a holding angle on a papermaking machine is large, water retained in the inner space of the fabric splashes. In the design of the invention, on the other hand, excessive water is not retained because it has a less inner space than the conventional fabric so that splash does not occur or splash decreases greatly even if a centrifugal force works.

The invention is characterized by introduction of a secondary weft to be substituted not for a warp but for a primary weft in order to decrease the inner space. The following are effects produced by substitution of a secondary weft not for a warp but for a primary weft.

First, in the finishing step in the fabric manufacture, heat treatment is conducted. In such a finishing step, a tension is applied to the fabric in the longitudinal direction of the fabric so that warps tend to extend in a straight direction and wefts bend strongly. Also during papermaking or the like, a tension is applied in the longitudinal direction. An inner space decreasing ratio is presumed to be greater by forming a long crimp with a weft showing strong bending than by forming it with a warp showing weak bending.

Next, it is difficult to change the density, material, diameter or the like of warps while they are set on a loom. In the case of wefts, on the other hand, specifications such as density, material, and diameter can be changed easily because they are only picked after setting.

The constitution mode of the secondary weft in the invention is not limited insofar as it permits formation of a long crimp in the inner space. For example, the secondary upper side weft may be placed only between primary upper side wefts. The secondary lower side weft may be placed only between primary lower side wefts. The secondary wefts may also be placed between primary upper side wefts and between primary lower side wefts. Two or more secondary upper side wefts may be placed between two primary upper side wefts. Moreover, all the upper side wefts may be substituted by secondary upper side wefts without a primary upper side weft.

A yarn to be used in the industrial two-layer fabric of the invention may be selected depending on its intended use. Examples of the yarns include, in addition to monofilaments, multi-filaments, spun yarns, finished yarns subjected to crimping or bulking such as so-called textured yarn, bulky yarn, and stretch yarn and yarns obtained by intertwining them. As the cross-section of the yarn, not only circular shape but also square shape, short shape such as stellar shape, elliptical shape, or hollow shape can be used. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool and metal. Of course, yarns obtained using copolymers or incorporating or mixing the above-described material with a substance selected depending on the using purpose may be used.

In particular, of the yarns to be used for the industrial two-layer fabric of the invention, secondary wefts for forming a knuckle in the inner space of the fabric are preferably polyester and polyamide.

Although various materials can be used as a papermaking wire or fabric, it is generally preferred to use a polyester monofilament having rigidity and excellent dimensional stability for upper side warps, lower side warps, warp binding yarns, and upper side wefts. On the other hand, as lower side wefts required to have wear resistance, those obtained by alternately arranging a polyester monofilament and a polyamide monofilament are preferred. Interweaving them makes it possible to improve wear resistance while keeping rigidity.

With regard to the diameter of a constituent yarn, the diameter of upper side wefts is preferably smaller than that of lower side wefts from the standpoint of surface smoothness and fiber supporting property. The diameter of warps may be selected as needed and all the warps may be of the same diameter. Alternatively, the diameter of lower side warps may be made greater than that of another warp. It can be selected as needed.

The industrial two-layer fabric according to the invention produces excellent effects of inhibiting transfer of marks to paper made using the fabric, generation of splash, or the like while maintaining properties which fabrics are required to have such as drainage property and rigidity as a result of reduction in a water retention amount in the inner space of the fabric during papermaking while keeping the surface smoothness and not increasing the mesh thickness.

EMBODIMENTS

Embodiments according to the invention will next be described referring to drawings. Embodiments shown below are only examples of the invention and do not limit the invention. FIGS. 1 to 12 show examples of the industrial two-layer fabric of the invention.

The industrial two-layer fabric according to the invention is characterized by that some or all of the upper side wefts and/or lower side wefts have been substituted by a secondary weft interwoven so as to make the number of warps passing on the surface or back side greater than the number of warps passing on the inner space side and a long crimp having a knuckle in the inner space has been formed by the secondary weft.

No particular limitation is imposed on the upper side weave pattern and it may be any of plain weave, twill weave, broken twill weave, satin weave, and randomly shifted satin weave, and the like design. Complete designs obtained using it are connected longitudinally and laterally to obtain a design excellent in diagonal rigidity, running stability, and wear resistance. The upper side weave pattern may be an upper side complete design comprised of plural kinds of warp complete designs. The upper side weave pattern may be selected as needed, depending on the structure of the secondary wefts substituted for the primary wefts.

No particular limitation is imposed also on the lower side weave pattern. For example, preferred is a design in which a primary lower side weft goes over two successive lower side warps and/or warp binding yarns and then goes under two or more successive lower side warps and/or warp binding yarns to form a long crimp of the primary lower side weft on the lower side surface of the lower side fabric. By employing a design in which two adjacent warps on the lower surface side simultaneously interweave with a single lower side weft next to each other, the long crimp of the lower side weft protrudes further from the surface so that the resulting fabric has improved wear resistance and at the same time improved rigidity. It is also recommended that two adjacent warps interweave with one lower side weft from the lower surface side and at this position, alternately approach warps lying on both sides, thereby forming substantially zigzag arrangement of warps. The upper side weave pattern may be selected as needed, depending on the substitution structure of secondary wefts.

In the design diagrams of FIGS. 1, 3, 5, 7, 9, 11 and 13, the symbol "x" indicates that an upper side warp (u) lies over a primary upper side weft (u) or a secondary upper side weft (s) to form a knuckle or a crimp of the upper side warp on the upper surface of the upper side fabric; the symbol "A" indicates that a warp binding yarn (b) interweaves with a primary upper side weft (u) or a secondary upper side weft (s); and the symbol "o" indicates that a lower side warp (d) lies under a primary lower side weft (d) or a secondary lower side weft (s) and forms a knuckle or a crimp on a lower surface of the lower side fabric.

Embodiment 1

FIG. 1 is the design diagram of Embodiment 1 relating to the industrial two-layer fabric of the invention. In Embodiment 1, a primary upper side weft and a secondary upper side weft are alternately arranged in the upper side fabric. No secondary lower side weft is arranged in the lower side fabric. FIG. 2A is a schematic view showing the longitudinal section taken along an upper side warp (1*u*) and a lower side warp (1*d*) of FIG. 1; FIG. 2B is a schematic view showing the longitudinal section taken along an upper side warp (2*u*) and a lower side warp (2*d*) of FIG. 1; and FIG. 2C is a schematic view showing the cross-section taken along an upper side weft (1'*u*) and a lower side weft (1'*d*) of FIG. 1. Upper side wefts and lower side wefts are arranged at a ratio of 4:1.

An upper side fabric has a 3/1-1/3 warp design in which an upper side warp goes over three upper side weft (secondary, primary and secondary upper side wefts) and then goes under one primary upper side wefts, thus forming a 3/1 design, and goes over one secondary upper weft and then goes under three upper wefts (primary, secondary and primary upper side wefts) thus forming a 1/3 design. As shown in FIG. 2A, the upper side warp (1*u*) goes over the primary upper side weft (1'*u*) and a secondary upper side weft (2'*s*), goes under a primary upper side weft (3'*u*), goes over a secondary upper side weft (4'*s*), goes under a primary upper side weft (5'*u*), a secondary upper side weft (6'*s*), and a primary upper side weft (7'*u*), goes over a secondary upper side weft (8'*s*), a primary upper side weft (9'*u*), and a secondary upper side weft (10'*s*), goes under a primary upper side weft (11'*u*), goes over a secondary upper side weft (12'*s*), goes under a primary upper side weft (13'*u*), a secondary upper side weft (14'*s*), and a primary upper side weft (15'*u*), and then goes over a secondary upper side weft (16'*s*). The upper side warp (2*u*) placed adjacent to the upper side warp (1*u*) creates a similar design while shifting the upper side warp (1*u*) by two upper side wefts. The warp binding yarn (2*b*) functions as a binding yarn by weaving an upper side weft (13'*u*) from the inside where the upper side warp (2*u*) interweaves with it. An upper side warp (3*u*) creates a similar design to that of the upper side warp (1*u*) by shifting its design by one upper side weft from the upper side weft (2*u*). An upper side warp (4*u*) adjacent to the upper side warp (3*u*) creates a similar design by shifting its design by two upper side wefts.

The upper side fabric and lower side fabric are bound by two warp binding yarns (2*b*) and (6*b*) which are arranged below the upper side warps (2*u*) and (6*u*), respectively, thereby form an inner space (S) between the upper side fabric and the lower side fabric.

No limitation is imposed on the lower side design. In Embodiment 1, the fabric has a lower side weft long crimp of the lower side weft (1'*d*) between the lower side warps (1*d*) and (8*d*) as shown in FIG. 2C so that the two-layer fabric shows good wear resistance. Described specifically, as shown in FIG. 2A, the lower side warp (1*d*) goes under the primary lower side weft (1'*d*) and goes over other primary lower side wefts (5'*d*, 9'*d*, 13'*d*), thus creating a 3/1 design. The lower side warp and a lower side warp adjacent thereto are simultaneously interwoven, from the lower side, with the same lower side weft at the positions of the symbols "o" "o" adjacent to each other as shown in FIG. 1 (e.g. the lower side warps (1*d*), (8*d*) at the lower side weft (1'*d*), the lower side warps (4*d*), (5*d*) at the lower side weft (9'*d*)) and these two lower side warps as a set create a 3/1 design of the lower side fabric. The warp binding yarn (2*b*) and a lower side warp (3*d*) create, as a set, a 3/1 design with the primary lower side weft (5'*d*). The warp binding yarn (6*b*) and a lower side warp (7*d*) create, as a set, a 3/1 design with the primary lower side weft (13'*d*) also.

As seen in FIG. 2C, the secondary upper side weft (2'*s*) forms a long crimp in the inner space (S) between the upper side warps (2*u*) and (6*u*) and between the upper side warps (6*u*) and (2*u*) of an adjacent repeating unit. The number of the upper side warps that pass under the primary upper side weft (1'*u*) is six (6) which is larger than the number of the upper side warps that pass over the primary upper side weft (1'*u*) which is two (2) so that the primary upper side weft (1'*u*) forms a long crimp on an upper surface of the upper side fabric. The number of the upper side warps passing on the secondary upper side weft (2'*s*) is six (6), which is larger than a number of the upper side warps passing under the secondary upper side weft (2'*s*) which is two (2), so that the secondary upper side weft forms the long crimp in the inner space (S) as stated above.

The industrial two-layer fabric having uniform drainage characteristics throughout the fabric can be provided according to the present embodiment by reducing a water retention amount in the inner space of the fabric during papermaking without increasing the thickness of a wire or fabric by using the secondary upper side wefts, thereby retaining required characteristics of the fabric such as drainage property, surface properties, and rigidity and at the same time, suppressing transfer of marks to paper made using the fabric, generation of splash, or the like.

Embodiment 2

FIG. 3 is the design diagram of Embodiment 2 relating to the industrial two-layer fabric of the invention. FIG. 4A is a schematic view showing the longitudinal section taken along an upper side warp (1*u*) and a lower side warp (1*d*) of FIG. 3; FIG. 4B is a schematic view showing the longitudinal section taken along an upper side warp (2*u*) and a warp binding yarn (2*b*) of FIG. 3; and FIG. 4C is a schematic view showing the cross-section taken along an upper side weft (1'*u*) and a lower side weft (1'*d*) of FIG. 3. The upper side fabric design is a satin weave design obtained by irregularly shifting a 1/3 warp design in which an upper side warp goes over one primary upper side weft and then goes under three primary upper side wefts. In the lower side fabric, a primary lower side weft and a secondary lower side weft are alternately arranged. The upper side wefts and the lower side wefts are arranged at a ratio of 1:1. One of four upper side warps (2*u*) or (6*u*) does not interweave with an upper side weft (7'*u*) or (3'*u*) at the site where it should interweave with the upper side weft (7'*u*) or (3'*u*) and a warp binding yarn (2*b*) or (6*b*) interweaves with the upper side weft (7'*u*) or (3'*u*) and functions as a binding yarn. Thus, they create a complete design. In other words, the upper side fabric and lower side fabric are bound by the two warp binding yarns (2*b*) and (6*b*) which are arranged below the upper side warps (2*u*) and (6*u*), respectively, thereby form an inner space (S) between the upper side fabric and the lower side fabric.

The lower side design of the primary lower side wefts is a 2/6 weft design in which primary lower side wefts (1'*d*, 3'*d*, 5'*d* and 7'*d*) and secondary lower side wefts (2'*s*, 4'*s*, 6'*s* and 8'*s*) are arranged alternately. A primary lower side weft (1'*d*, 3'*d*, 5'*d* or 7'*d*) goes over two lower side warps and then goes under six lower side warps thereby forming a long crimp on the lower side surface of the lower fabric. With regard to secondary lower side wefts (4'*s* and 8'*s*), referring to FIG. 3, a secondary lower side weft (4'*s*) or (8'*s*) goes under two lower side warps (as shown by two blank boxes), goes over three lower side warps (as shown by three "○" "○" "○"), goes under one lower side warp (as shown by a blank box) and goes over two lower side warps (as shown by a single "○"), thus creating a 2/2-3/1 weft design. Another secondary lower side weft (2'*s*) or (6'*s*) goes over two lower side warps (as shown by two adjacent "○" and "○"), under one lower side warp (as shown by one blank box), over two lower side warps (as shown by another two adjacent "○" and "○"), under one lower side warp (as shown by another one blank box), over one lower side warp (as shown by a single "○"), and under one lower side warp (as shown by one blank box), thus creating a 2/1-2/1-1/1 weft design. The secondary lower side warp of the 2/2-3/1 design and that of the 2/1-2/1-1/1 design are arranged alternately.

As shown in FIG. 4C, the secondary lower side weft (2'*s*) goes over one lower side warp (1*d*) and one warp binding yarn (2*b*), forms a long crimp in the inner space (S) between the lower side warps (8*d*) and (3*d*), goes under one lower side warp (3*d*), goes over two lower side warps (4*d*, 5*d*), forms a long crimp again in the inner space (S) between the lower side warps (3*d*) and (6*d*), goes under one warp binding yarn (6*b*), goes over one lower side warp (7*d*), and goes under one lower side warp (8*d*), and thus forming a long crimp of the secondary lower side weft. The number of the lower side warps passing under the secondary lower side weft is five (5) which is larger than the number of the lower side warps passing over the secondary lower side weft which is three (3) in the repeating unit in either the 2/2-3/1 design case or the 2/1-2/1-1/1 design case, so that the secondary lower side weft forms a long crimp in the inner space (S).

The industrial two-layer fabric having uniform drainage characteristics throughout the fabric can be provided according to the present embodiment by reducing a water retention amount in the inner space of the fabric during papermaking without increasing the thickness of a wire or fabric, thereby retaining required characteristics of the fabric such as drainage property, surface properties, and rigidity and at the same time, suppressing transfer of marks to paper made using the fabric, generation of splash, or the like.

Embodiment 3

Figure 5:
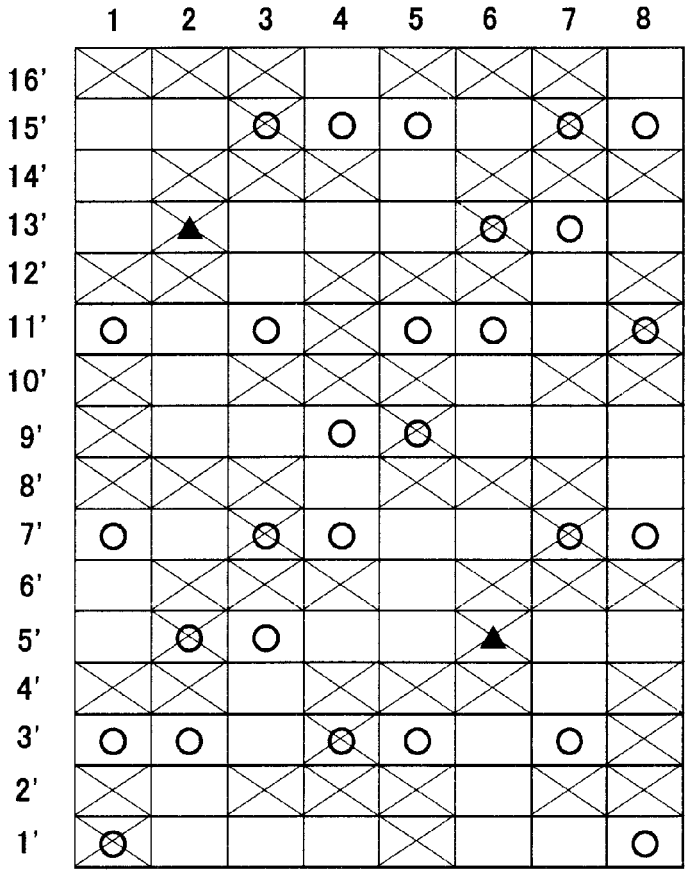
FIG. 5 is a design diagram showing the complete design of Embodiment 3 according to the invention.

FIG. 5 is the design diagram of Embodiment 3 relating to the industrial two-layer fabric of the invention. FIG. 6A is a schematic view showing the longitudinal section taken along an upper side warp (1*u*) and a lower side warp (1*d*) of FIG. 5; FIG. 6B is a schematic view showing the longitudinal section taken along an upper side warp (2*u*) and a warp binding yarn (2*b*) of FIG. 5; and FIG. 6C is a schematic view showing the cross-section taken along an upper side weft (1'*u*) and a lower side weft (1'*d*) of FIG. 5.

The upper side fabric design is a design similar to that of Embodiment 1 in which primary upper side wefts (1'*u*, 3'*u*, 5'*u*, 7'*u*, 9'*u*, 11'*u*, 13'*u* and 15'*u*) and secondary upper side wefts (2'*s*, 4'*s*, 6'*s*, 8'*s*, 10'*s*, 12'*s*, 14'*s* and 16'*s*) are arranged alternately. The lower side design is a design similar to that of Embodiment 2 in which primary lower side wefts (1'*d*, 5'*d*, 9'*d* and 13'*d*) have a 2/6 weft design and secondary lower side wefts (3'*s*, 7'*s*, 11'*s* and 15'*s*) have the 2/2-3/1 design (7'*s* and 15'*s*) and the 2/1-2/1-1/1 design (3'*s* and 11'*s*), that are arranged alternately.

The Primary lower side wefts and secondary lower side wefts are arranged alternately. Primary upper side wefts and secondary upper side wefts, and primary lower side wefts and secondary lower side wefts are arranged at a ratio of 2:1.

The upper side fabric and lower side fabric are bound by two warp binding yarns (2*b*) and (6*b*) which are arranged below the upper side warps (2*u*) and (6*u*), respectively, thereby form an inner space (S) between the upper side fabric and the lower side fabric.

As shown in FIG. 6C, a secondary upper side weft (2'*s*) goes over one upper side warp (2*u*), goes under three upper side warps (3*u* to 5*u*) to form a long crimp or knuckle in the inner space (S) between the upper side warps (2*u*) and (6*u*), goes over one upper side warp (6*u*), goes under three upper side warps (7*u*, 8*u*, 1*u*) to form a long crimp or knuckle again between the upper side warps (6*u*) and (2*u*) of the adjacent repeating unit, and thereby forms a long crimp with the secondary upper side weft in the inner space (S). A secondary lower side weft (3'*s*) goes over one lower side warp (1*d*) and one warp binding yarns (2*b*) to form a long knuckle or crimp in the inner space between the lower side warps (8*d*) and (3*d*), goes under one lower side warp (3*d*), goes over two lower side warps (4*d*, 5*d*) to form a long knuckle or crimp again between the lower side warp (3*d*) and warp binding yarn (6*b*), goes under one warp binding yarn (6*b*), goes over one lower side warp (7*d*), and goes under one lower side warp (8*d*).

The number of the upper side warps passing on the secondary upper side weft (2'*s*) is six (6) which is larger than the number of the upper side warps passing under the secondary upper side weft (2'*s*) which is two (2) in a repeating unit, so that the secondary upper side weft (2'*s*) forms a long crimp in the inner space (S). The number of the lower side warps passing under the secondary lower side weft (3'*s*) is five (5) which is larger than the number of the lower side warps passing over the secondary lower side weft (3'*s*) which is three (3) in the repeating unit in either the 2/2-3/1 design case or the 2/1-2/1-1/1 design case, so that the secondary lower side weft forms a long crimp in the inner space (S).

The industrial two-layer fabric having uniform drainage characteristics throughout the fabric can be provided according to the present embodiment by reducing a water retention amount in the inner space of the fabric during papermaking without increasing the thickness of a wire or fabric, thereby retaining required characteristics of the fabric such as drainage property, surface properties, and rigidity and at the same time, suppressing transfer of marks to paper made using the fabric, generation of splash, or the like.

Embodiment 4

Figure 7:
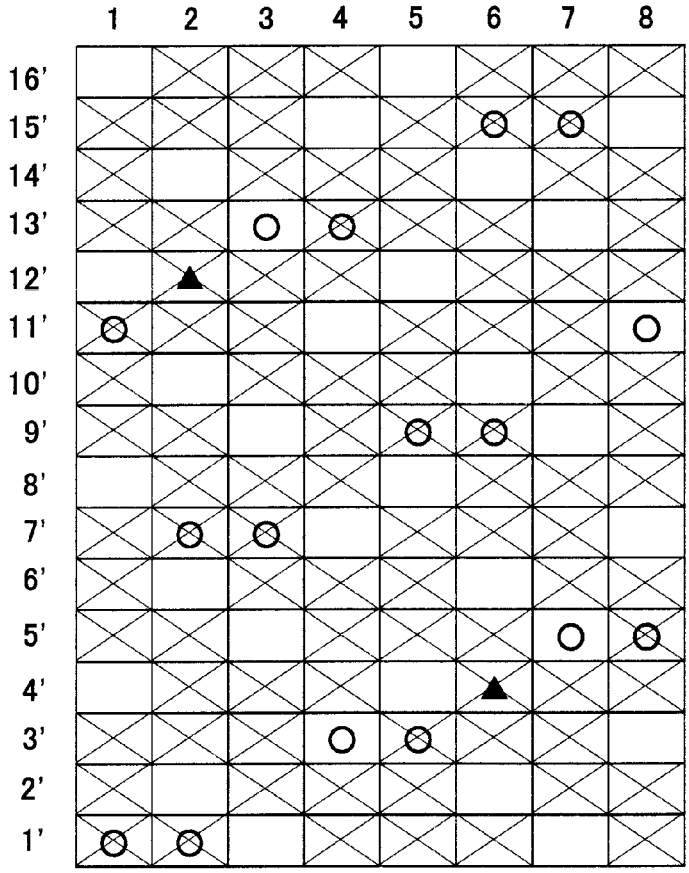
FIG. 7 is a design diagram showing the complete design of Embodiment 4 according to the invention.

FIG. 7 is the design diagram of Embodiment 4 relating to the industrial two-layer fabric of the invention. FIG. 8A is a schematic view showing the longitudinal section taken along an upper side warp (1*u*) and a lower side warp (1*d*) of FIG. 7; FIG. 8B is a schematic view showing the longitudinal section taken along an upper side warp (2*u*) and a warp binding yarn (2*b*) of FIG. 7; and FIG. 8C is a schematic view showing the cross-section taken along an upper side secondary yarn (1'*s*) and a lower side weft (1'*d*) of FIG. 7. All the upper side wefts are secondary upper side wefts. No primary upper side weft is used in the upper side fabric. The secondary upper side wefts and primary lower side wefts are arranged at a ratio of 2:1.

In the upper side fabric design, all the upper side wefts are substituted by secondary wefts. An upper side warp goes over three secondary upper side wefts and goes under one secondary weft, thus creating a 3/1 design. In the lower side fabric design, a lower side warp goes over two primary lower side wefts, under one primary lower side weft, over four primary lower side wefts, and under one primary lower side weft, thus creating a 2/1-4/1 design. A lower side warp adjacent to it is placed by shifting its design by three lower side wefts so that two adjacent lower side warps are woven by the same lower side weft at a "○" "○" location as shown in FIG. 7. No secondary lower side weft is used in the lower side fabric. The upper side fabric and lower side fabric are bound by two warp binding yarns (2*b*) and (6*b*) which are arranged below the upper side warps (2*u*) and (6*u*), respectively, thereby form an inner space (S) between the upper side fabric and the lower side fabric.

As shown in FIG. 8C, a secondary upper side weft (1'*s*) goes over one upper side warp (3*u*) and goes under three upper side warps (4*u* to 6*u*) to form a long crimp or knuckle in the inner space (S) between the upper side warps (3*u*) and (7*u*), goes over one upper side warp (7*u*), goes under three upper side warps (8*u*, 1*u*, 2*u*) to form a long crimp or knuckle again in the inner space (S) between the upper side warps (7*u*) and (3*u*). The number of the upper side warps passing on the secondary upper side weft (1'*s*) is six (6) which is larger than the number of the upper side warps passing under the secondary upper side weft (2'*s*) which is two (2) in a repeating unit, so that the secondary upper side weft (2'*s*) forms a long crimp in the inner space (S).

The industrial two-layer fabric having uniform drainage characteristics throughout the fabric can be provided according to the present embodiment by reducing a water retention amount in the inner space of the fabric during papermaking without increasing the thickness of a wire or fabric, thereby retaining required characteristics of the fabric such as drainage property, surface properties, and rigidity and at the same time, suppressing transfer of marks to paper made using the fabric.

Embodiment 5

Figure 9:
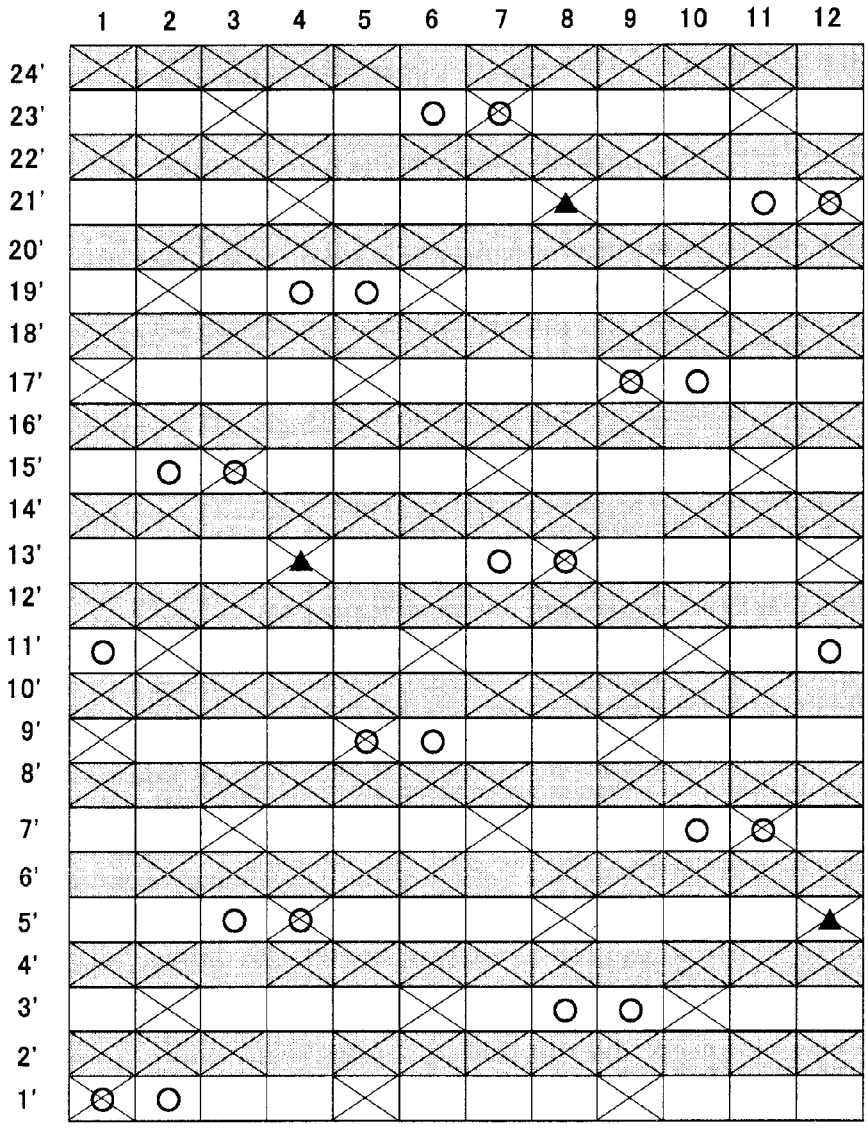
FIG. 9 is a design diagram showing the complete design of Embodiment 5 according to the invention.

FIG. 9 is the design diagram of Embodiment 5 relating to the industrial two-layer fabric of the invention. FIG. 10A is a schematic view showing the longitudinal section taken along an upper side warp (1*u*) and a lower side warp (1*d*); FIG. 10B is a schematic view showing the longitudinal section taken along an upper side warp (4*u*) and a warp binding yarn (4*b*); and FIG. 10C is a schematic view showing the cross-section taken along an upper side weft (1'*u*) and a lower side weft (1'*d*). One upper side weft and one upper side secondary weft are placed alternately and upper side wefts. Primary and secondary upper side wefts and lower side wefts are arranged at a ratio of 2:1.

The upper side fabric design is a design similar to that of Embodiments 1 and 3 in which primary upper side wefts (1'*u*, 3'*u*, 5'*u*, 7'*u*, 9'*u*, 11'*u*, 13'*u*, 15'*u*, 17'*u*, 19'*u*, 21'*u* and 23'*u*) and secondary upper side wefts (2'*s*, 4'*s*, 6'*s*, 8'*s*, 10'*s*, 12'*s*, 14'*s*, 16'*s*, 18'*s*, 20'*s*, 22'*s* and 24'*s*) are arranged alternately. In the upper side fabric design, the primary upper side weft goes over three upper side warps and then goes under one upper side warp, thus creating a 3/1 design. One secondary upper side weft goes over one upper side warp and then going under five upper side warps, thus forming a 1/5 design. The primary and secondary upper side wefts are placed alternately. The upper side fabric and lower side fabric are bound by three warp binding yarns (4*b*), (8*b*) and (12*b*) which are arranged below the upper side warps (4*u*), (8*u*) and (6*u*), respectively, thereby form an inner space (S) between the upper side fabric and the lower side fabric.

No limitation is imposed on the lower side design. In Embodiment 5, a lower side warp goes over four primary lower side wefts, under one primary lower side weft, over six primary lower side wefts, and under one primary lower side weft, thus forming a 4/1-1/6 design. No secondary lower side weft is used in this embodiment. A lower side warp adjacent to it has a design obtained by shifting it by seven lower side wefts so that the two adjacent lower side warps are woven with the same lower side warp at a "○" "○" location as shown in FIG. 9.

As shown in FIG. 10C, in the upper side fabric design, the primary upper side weft (1'*u*) goes over three upper side warps (2*u*, 3*u* and 4*u*, 6*u*, 7*u* and 8*u*, or 10*u*, 11*u* and 12*u*) and then goes under one upper side warp (5*u*, 9*u*, or 1*u*), thus creating a 3/1 design. The secondary upper side weft (2'*s*) goes over one upper side warp (4*u* or 10*u*) and then going under five upper side warps (5*u* through 9*u* or 11*u* through 3*u*), thus forming a 1/5 design, so that the secondary upper side weft (2'*s*) forms a long crimp in the inner space (S). The number of the upper side warps passing on the secondary upper side weft (2'*s*) is ten (10) which is larger than the number of the upper side warps passing under the secondary upper side weft (2'*s*) which is two (2) in a repeating unit, so that the secondary upper side weft (2'*s*) forms a long crimp in the inner space (S).

The industrial two-layer fabric having uniform drainage characteristics throughout the fabric can be provided according to the present embodiment by reducing a water retention amount in the inner space of the fabric during papermaking without increasing the thickness of a wire or fabric, thereby retaining required characteristics of the fabric such as drainage property, surface properties, and rigidity and at the same time, suppressing transfer of marks to paper made using the fabric, generation of splash, or the like.

Embodiment 6

Figure 11:
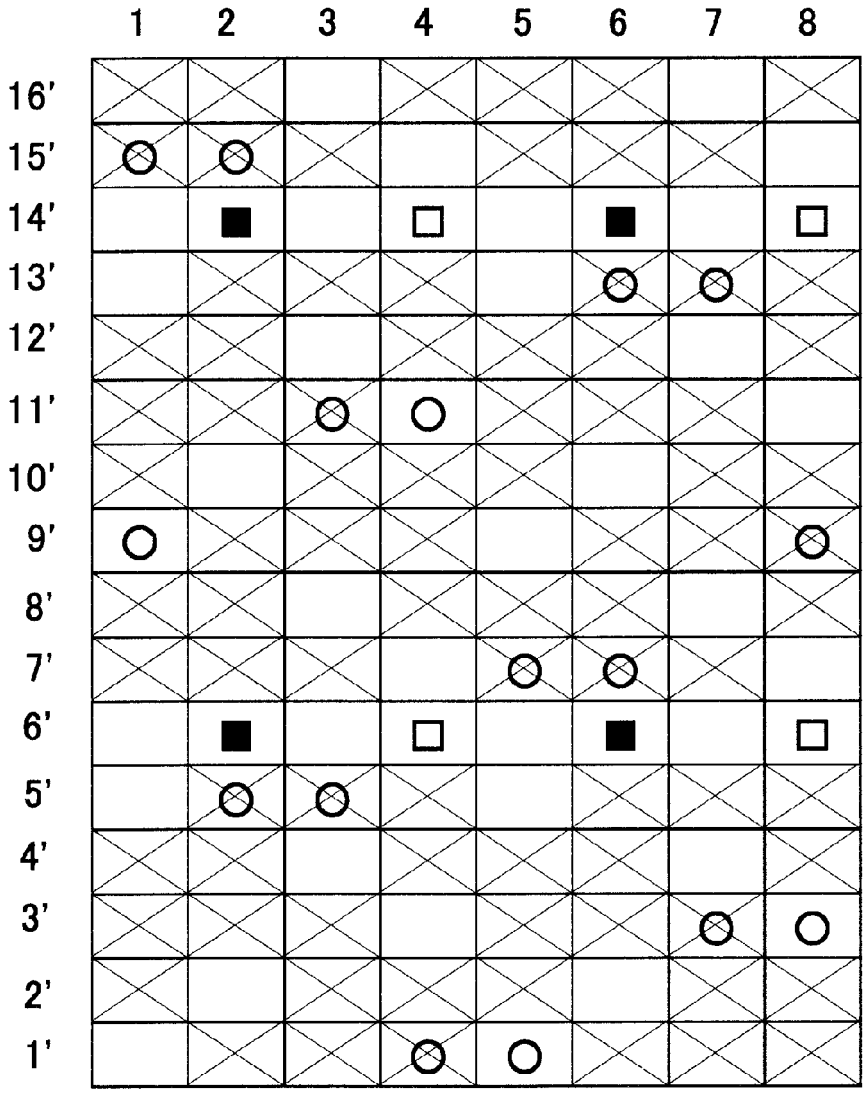
FIG. 11 is a design diagram showing the complete design of Embodiment 6 according to the invention.

FIG. 11 is the design diagram of Embodiment 6 relating to the industrial two-layer fabric of the invention. FIG. 12A is a schematic view showing the longitudinal section taken along an upper side warp (1*u*) and a lower side warp (1*d*); FIG. 12B is a schematic view showing the longitudinal section taken along an upper side weft (5'*s*) and a lower side weft (5'*d*). All the upper side wefts are secondary upper side wefts excepting for two weft binding yarns (6'*b* and 14'*b*). All of the lower side wefts are primary lower side wefts. The upper side secondary wefts including two weft binding yarns and primary lower side wefts are arranged at a ratio of 2:1. The upper side fabric and lower side fabric are bound by two weft binding yarns (6'*b*) and (14'*b*) which are arranged below the upper side warps (6*u*) and (14*u*), respectively, thereby form an inner space (S) between the upper side fabric and the lower side fabric.

In the upper side design, an upper side warp goes over three upper side wefts and then goes under one upper side weft and thus forms a 3/1 design. Weft binding yarns (6'*b*) and (14'*b*) interweave with upper side warps (2*u*) and (6*u*) and lower side warps (4*d*) and (8*d*). The weft binding yarns (6'*b*) and (14'*b*) binds the upper side fabric and the lower side fabric thereby forming an inner space (S) between the upper side fabric and the lower side fabric.

No limitation is imposed on the lower side design. In Embodiment 6, a lower side warp goes over two lower side wefts, goes under one lower side weft, goes over four lower side wefts, and then goes under one lower side weft, thus forming a 2/1-4/1 design. A lower side warp adjacent to it is placed after shifting it by three lower side wefts so that the two adjacent lower side warps are woven with the same lower side warp at a "○" "○" location in FIG. 11.

As shown in FIG. 12B, the secondary upper side weft (5'*s*) goes over one upper side warp (1*u*), goes under three upper side warps (2*u* to 4*u*) to form a long crimp or knuckle in the inner space (S) between the upper side wefts (1*u*) and (5*u*), goes over one upper side warp (5*u*) again, goes under three upper side warps (6*u* to 8*u*) to form a long crimp or knuckle again in the inner space (S) between the upper side wefts (5*u*) and (1*u*). The number of the upper side warps passing on the secondary upper side weft (5'*s*) is six (6) which is larger than the number of the upper side warps passing under the secondary upper side weft (5'*s*) which is two (2) in a repeating unit, so that the secondary upper side weft (2'*s*) forms a long crimp in the inner space (S).

The industrial two-layer fabric having uniform drainage characteristics throughout the fabric can be provided according to the present embodiment by reducing a water retention amount in the inner space of the fabric during papermaking without increasing the thickness of a wire or fabric, thereby retaining required characteristics of the fabric such as drainage property, surface properties, and rigidity and at the same time, suppressing transfer of marks to paper made using the fabric, generation of splash, or the like.

The preceding description has been presented only to illustrate and describe exemplary embodiments of the present industrial two-layer fabric. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An industrial two-layer fabric comprising:

an upper side fabric comprising upper side warps and upper side wefts that are woven with the upper side warps; and a lower side fabric comprising lower side warps and lower side wefts that are woven with the lower side warps;

the upper side fabric and the lower side fabric are interwoven with a warp binding yarn or a weft binding yarn and thereby form an inner space between the upper side fabric and the lower side fabric; wherein:

the upper side wefts include at least one of a primary upper side weft and a secondary upper side weft, a number of the upper side warps passing under the primary upper side weft is larger than a number of the upper side warps passing on the primary upper side weft so that the primary upper side weft forms a longer crimp on an upper surface of the upper side fabric than a crimp in the inner space, a number of the upper side warps passing on the secondary upper side weft is larger than a number of the upper side warps passing under the secondary upper side weft so that the secondary upper side weft forms a longer crimp in the inner space than a crimp on the upper surface; and the lower side wefts include a primary lower side weft and a secondary lower side weft, a number of the lower side warps passing over the primary lower side weft is larger than a number of the lower side warps passing under the secondary lower side weft so that the primary lower side weft forms a long crimp on a lower surface of the lower side fabric than a crimp in the inner space, a number of the lower side warps passing under the secondary lower side weft is larger than a number of the lower side warps passing over the secondary lower side weft so that the secondary lower side weft forms a longer crimp in the inner space than a crimp on the lower surface.

2. The industrial two-layer fabric according to claim 1, wherein the lower side wefts do not include the secondary lower side weft.

3. The industrial two-layer fabric according to claim 1, wherein the primary upper side weft and the secondary upper side weft are placed alternately.

4. The industrial two-layer fabric according to claim 1, wherein the upper side wefts include the primary upper side weft only.

5. The industrial two-layer fabric according to claim 1, wherein the upper side wefts include the secondary upper side weft only.

6. The industrial two-layer fabric according to claim 1, wherein the primary lower side weft and the secondary lower side weft are placed alternately.

7. The industrial two-layer fabric according to claim 1, wherein the upper side wefts include the primary upper side weft and secondary upper side weft, and the lower side wefts include the primary lower side weft and secondary lower side weft.

* * * * *